United States Patent [19]

Mutter et al.

[11] Patent Number: 4,677,387

[45] Date of Patent: Jun. 30, 1987

[54] PACKAGE QUALITY MONITOR

[75] Inventors: Heinz Mutter, Winterthur; Hans-Jörg Sommer, Zurich; Felix Graf, Winterthur; Armin Wirz, Ossingen, all of Switzerland

[73] Assignee: Rieter Machine Works, Ltd., Winterthur, Switzerland

[21] Appl. No.: 570,203

[22] Filed: Jan. 12, 1984

[51] Int. Cl.[4] ..... G01N 27/60

[52] U.S. Cl. ..... 324/454; 242/18 A; 242/18 DD; 242/36

[58] Field of Search ..... 324/109, 452, 454–458, 324/71.1; 73/160; 33/127; 242/18 A, 18 DD, 36; 28/186, 187, 196, 227, 289; 340/677

[56] References Cited

U.S. PATENT DOCUMENTS

| | | | |
|---|---|---|---|
| 2,980,855 | 4/1961 | Moore | 324/454 |
| 3,037,162 | 5/1962 | Jones et al. | 242/36 |
| 3,360,830 | 1/1968 | Wilson | 19/0.26 |
| 3,514,615 | 5/1970 | Noiles et al. | 242/36 |
| 3,643,883 | 2/1972 | Wuest | 242/36 |
| 4,133,207 | 1/1979 | Weidmann et al. | 73/160 |
| 4,256,247 | 3/1981 | Loepfe | 324/454 |

FOREIGN PATENT DOCUMENTS

| | | | |
|---|---|---|---|
| 1940272 | 8/1969 | Fed. Rep. of Germany . | |
| 2907653 | 8/1980 | Fed. Rep. of Germany . | |
| 97175 | 4/1973 | German Democratic Rep. . | |
| 58-67848 | 9/1983 | Japan . | |
| 479478 | 11/1969 | Switzerland . | |
| 596078 | 2/1978 | Switzerland . | |
| 598116 | 4/1978 | Switzerland . | |
| 517861 | 8/1976 | U.S.S.R. | 324/452 |

OTHER PUBLICATIONS

Kirkwood et al, "Measurement of Triboelectric Response of Raw Cottons", Textile Research Journal, vol. 24, No. 9, Sep. 1954.

*Primary Examiner*—Stewart J. Levy
*Assistant Examiner*—Kevin D. O'Shea
*Attorney, Agent, or Firm*—Kenyon & Kenyon

[57] ABSTRACT

The monitor is spaced a small distance from the curved path of the travelling thread to sense defects in the thread. In one embodiment, the monitoring means is spaced from the winding surface of a chuck to sense broken threads or an accurate build-up of the thread package. The monitoring means includes a detector head with a charge collector rod for sensing changes in electrical potential of the rod due to contact with a travelling thread part. The monitoring means can be moved away from the chuck to maintain a constant distance from the thread package being wound on a bobbin tube on the chuck.

14 Claims, 4 Drawing Figures

PACKAGE QUALITY MONITOR

Figure 1:
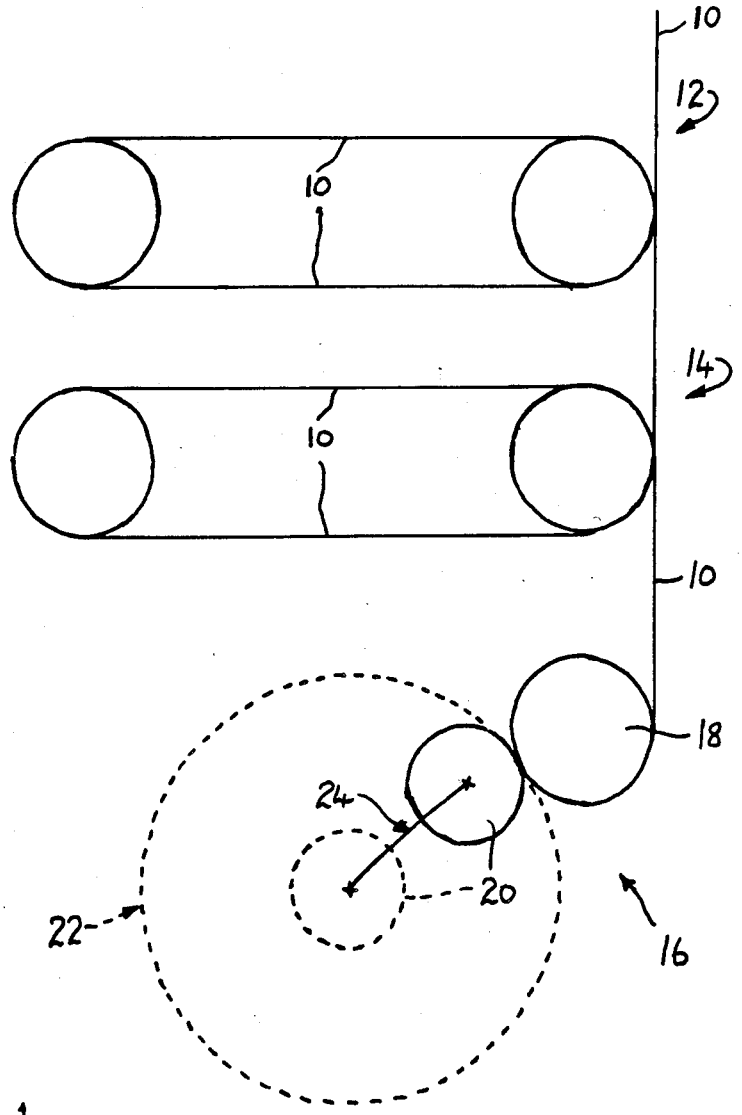

The present invention relates to a method and apparatus for monitoring the 'degree of compactness' of a thread or body of thread, for example a thread package. The expression 'degree of compactness' as used in this specification refers to whether or not a thread or body of thread remains within a predetermined spatial envelope. The degree of compactness can itself be used as a measure of another parameter, such as "package quality".

The method and apparatus according to the invention have a number of different practical applications in the thread processing field. In one example, the invention is applicable to the detection of broken filaments in a plastic-filament tow, since such filaments tend to produce an end projecting from the envelope of the tow structure, this projecting end being detectable by a method and apparatus as disclosed herein. In a second practical application, the inventive method and apparatus can be used to detect faulty build-up of a thread package where such faulty build-up leads to projection of thread loops slightly beyond the designed package envelope. The two applications mentioned above are given as examples only and do not exclude the use of the inventive method and apparatus in other practical applications.

The degree of compactness of a thread itself is usually important to the users of the thread. A compact thread is generally relatively easy to process, for example in knitting or weaving, and enables production of products of relatively high quality. On the other hand a non-compact thread structure leads to relatively frequent thread breaks during processing and to relatively low quality end products. In general terms the same remarks apply to the degree of compactness of a body of thread such as a thread package. As will be explained, the degree of compactness can be taken as an indicator of the desired (or faulty) build-up of a thread package.

PRIOR ART

U.S. Pat. No. 2,188,754 describes a method and apparatus for detecting broken filaments or 'fuzz' in manufacture of rayon filament tow. In particular, in FIG. 10 of that specification a fuzz detector is proposed in the form of an electrically-conductive wire ring encircling a thread path and electrically connected to a detector for electric charge. Means is provided to apply an electric charge to the thread before it passes through the ring, and transfer of a significant proportion of the applied charge from the thread to the ring is taken as an indication of the presence of broken filaments.

Apart from the operational difficulty of threading a filament tow through such a ring, the arrangement shown in the U.S. Patent specification nowhere deals with the problem of guiding the thread in such manner that transfer of charge from the thread to the ring is dependent solely upon broken filaments and not upon wandering of the tow from a desired thread path. Furthermore, the U.S. specification pays no attention to the question of whether a broken filament end projects sufficiently far out from the normal thread path to engage the detector ring.

INVENTION

In the following, a device for monitoring the degree of compactness of a thread or body of thread is referred to simply as a 'monitoring device', and a corresponding method is referred to simply as a 'monitoring method'.

A monitoring device and method according to the invention enable detection of the presence of thread at a predetermined location. This location can be set at a predetermined spacing from a given thread path. The thread path can be curved in the region of the location which can be arranged radially outwardly of the curved thread path. Thus an uncontrolled thread portion on the path can be stretched out by centrifugal force towards the location when the thread is moved along the path.

The thread to be monitored may have a filamentary structure. That is, the thread may comprise one or more filaments extending continuously along the length of the thread. Alternatively, the thread may have a fibrous-structure; that is, the thread may be made up of relatively short fibers twisted together to produce the thread-structure.

The 'presence of thread' at the location may involve, e.g. the presence of a thread loop at the location or the presence of only a thread component at the location. The 'component' may comprise the projecting end of an individual, broken filament of a multi-filamentary structure, or a projecting 'hair' or 'fibril' in a mono-filamentary or fibrous structure.

There may be a means for detecting presence of thread at the location, preferably by physical contact of thread with a detector element at the location. Detection of physical contact between the thread and the detector element may be effected by detecting transfer of electrical charge from the thread to the element. The charge detector may comprise a processing circuit arranged to process an electrical output signal supplied by a charge collector. The processing circuit may be arranged to filter out undesired compoments from the collector output signal. The location may be movable to maintain a desired spacing from a movable thread path. The thread path of interest may comprise the outermost winding of a cross-wound thread package. The thread and thread package may be monitored continuously during build-up of the package, the location therefore moving continuously outwardly from the longitudinal axis of the package in order to allow for the package build-up. The locus of the detector location may also be dependent upon movement of the package axis, e.g. along a predetermined path away from a friction roll of a conventional filament winding machine.

In this case the package winding system itself provides the guide means which guides the thread along a well-defined thread path. The winding system may be of a well-known type, e.g. one of the currently available winders for synthetic plastic filaments or the wind up of a spinning machine or other yarn processing machine. Such winding systems conventionally include a holder for a bobbin tube means for rotating the holder to wind the thread about the tube and means for reciprocating the thread axially of the tube to build up a package thereon. It is generally the aim of such winding systems to produce an accurately wound package with a desired package build.

Alternatively, the arrangement can be simplified by setting the location relative to a fixed portion of the thread path, e. g. where the thread travels around a cylindrical guide surface. The guide surface itself may be rotating about an axis which is fixed relative to the location. This arrangement can be achieved, e.g., if the detection location is set relative to the friction drive roll of a conventional filament winding machine.

Where a detector element is provided at the location and the latter is movable in operation, the detector element may be supported by an ajustable mounting means. Sensor means may be provided to sense spacing of the detector elements from the thread path and adjusting means may be provided to adjust the position of the detector element in response to an output of the sensor means.

Alternatively, where movement of the thread path is associated with movement of a part of an apparatus, e.g. movement of a carrier for a thread package during build up of the package, detector element may be made responsive to movement of the said part of the apparatus.

Figure 2:
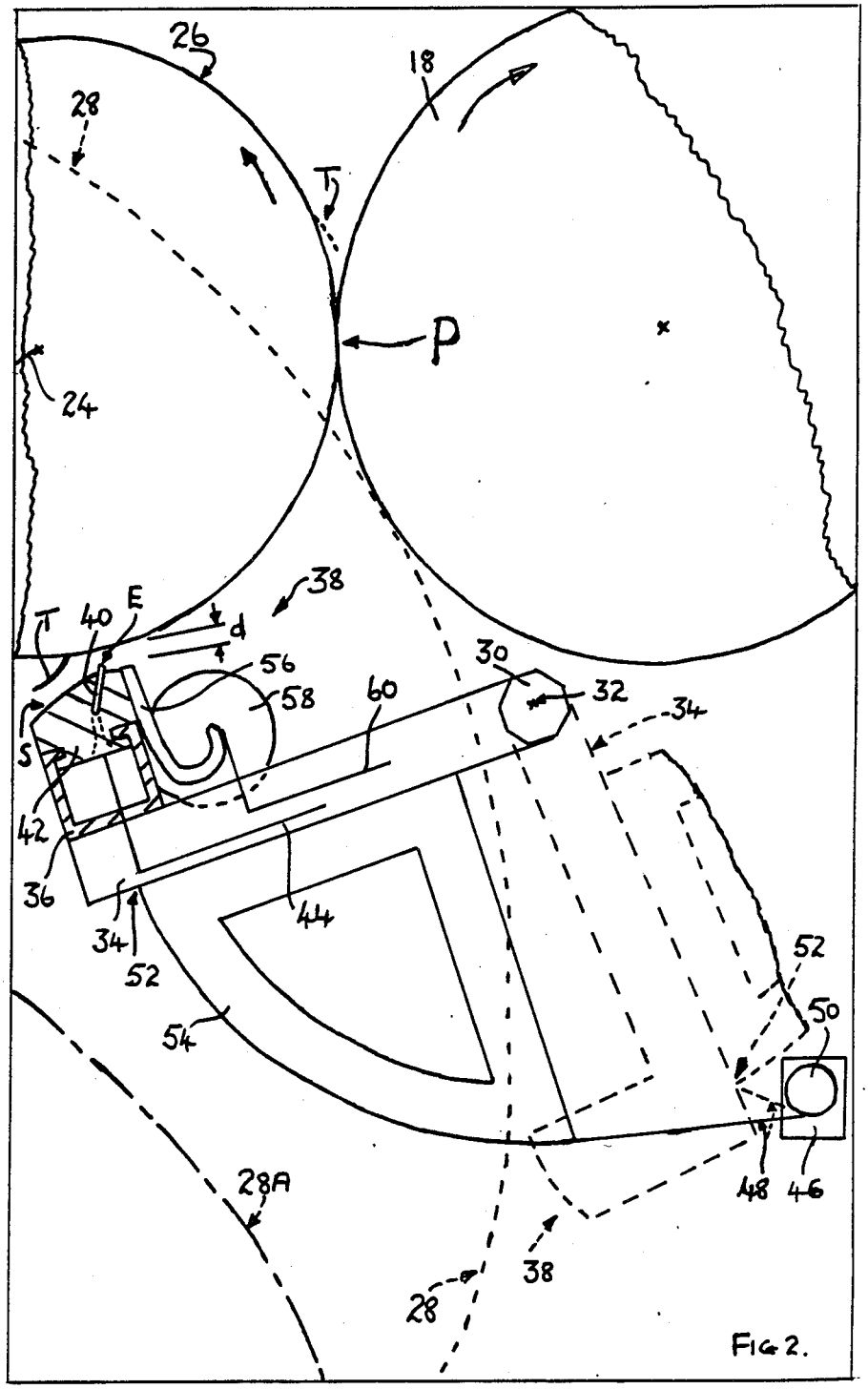
Figure 3:
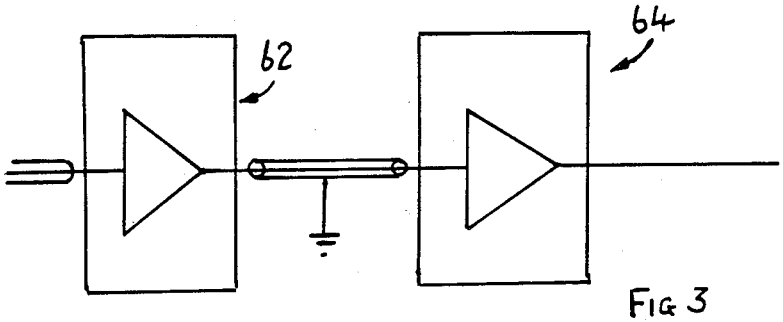
Figure 3A:
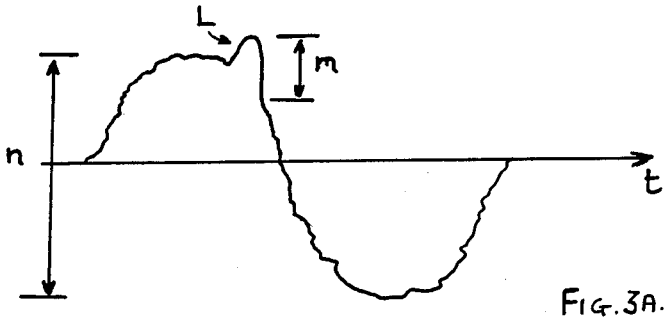

By way of example, one embodiment of the invention will now be described with reference to the accompanying diagramatic drawings, in which:

FIG. 1 is a diagramatic elevation of the draw-wind portion of a spin-draw- winding machine for processing synthetic plastic filaments, FIG. 2 is the further diagramatic elevation on a large scale showing details of a winding apparatus including monitoring means according to the invention, FIG. 3 is a curcuit diagram of a device for evaluating the output signal from the monitoring means shown in FIG. 2 and FIG. 3A is a diagram for use in explanation of FIG. 3.

The spin-draw-winding machine, shown in FIG. 1, has been highly simplified, since the details of such an arrangement are not essential to the invention. Further details of suitable arrangements can be found from the brochures of Rieter Machine Works Ltd./Winterthur, Switzerland describing the Rieter Spin-draw-winder Models J7/7 and J7/5. However, the Rieter Machines are cited only as examples of possible thread line arrangements. The invention is not limited to any specific thread line system.

In FIG. 1, the thread 10 leaving the spinning cabinet (not shown) passes around a first pair of drawing rollers 12 and a second pair of drawing rollers 14 before passing to a wind-up 16. Apart from the brochures referred to above, further details of the drawing system can be found in U.S. Pat. No. 3,604,659, the disclosure of which is hereby incorporated by reference.

In the illustrated form, wind-up 16 comprises a friction drive roll 18 which is rotatable by means (not shown) about a longitudinal roll axis. The wind-up further includes at least one chuck 20 extending parallel to drive roll 18. Chuck 20 carries in use at least one bobbin tube upon which a thread package 22 is built up during a winding operation.

In the illustrated arrangement, the longitudinal axis of roll 18 is assumed to be fixed relative to the drawing system, and wind-up 16 is of the so called 'print friction' type in which the thread 10 passes around a portion of the circumference of roll 18 before being transferred from the roll to a package forming on the chuck.

Chuck 20 is therefore movable by means (not shown) along a predetermined path (represented in FIG. 1 by the locus 24 of movement of the longitudinal chuck axis) between an initial winding position (illustrated in full lines) in which an empty bobbin tube carried by the chuck engages drive roll 18 and final winding position (illustrated in dotted lines) in which a full package 22 has built-up between the chuck and the drive roll.

After completion of winding of a full package, the winding operation is broken off and the chuck 20 is moved further away from drive roll 18 into a rest position (not shown) in which the full package can be removed from the chuck and replaced by an empty bobbin tube. When there is only a single chuck 20, the spinning and drawing operation must also be broken off until chuck 20 can be moved back to its initial winding position ready to start a new winding operation. However, chuck 20 may be one of a pair of chucks in the wind-up 16 a winding operation on the second chuck ( not shown) being started as soon as the winding operation on chuck 20 has been broken off. This enables continuous spinning and drawing of filament. A suitable wind-up is shown in the brochures referred to above and another, preferred, form of wind-up is shown in U.S. Pat. No. 4,524,918 (corresponding with European published patent application No. 73930, published Mar. 16, 1983).

During a winding operation chuck 20 is driven into rotation about its longitudinal chuck axis. The necessary drive can be taken from friction roll 18 and/or from a drive motor (not shown) coupled directly to the chuck 20. The latter arrangement is shown, e.g., in U.S. Pat. No. 4,548,366 (corresponding with European patent application No. 83102495.5 filed Mar. 14, 1983).

Wind-up 16 may of course include further elements such as a traverse device to traverse the thread longitudinally of the chuck during a winding operation. These additional elements may be conventional and details are of no relevance to the present invention; they have therefore been excluded from the drawings.

Normally, thread 10 is a multi-filamentary structure. That is, the thread is made up of a large number of individual filaments. The filaments are extruded simultaneously through a spinneret (not shown) and are cooled to a condition in which they can be handled as a single thread 10. At a single processing 'station' as shown in FIG. 1, a plurality of threads 10 may be processed simultaneously by spacing them axially on the draw-roll-system and the wind-up. The principles of the present invention can be adequately explained by reference to a single thread as illustrated, but the extension of the system to processing of a plurality of threads will be referred to again later.

After removal from wind-up 16 a full package of thread is passed to further processing operations the exact form of which will depend upon the type of thread. Certain threads will, e. g., be passed to knitting or weaving operations, others will be passed to tire-making operations. Various intermediate processing steps can be used depending upon the desired end use of the thread. For all of these further processing operations, the 'quality' of an individual thread package is an important characteristic. The 'quality' of a package clearly depends upon a large number of parameters, but two are of special significance in the present context, namely:

(a) the continuity of each individual filament throughout the total length of thread wound into the package, and (b) the accurate build up of the package with each thread winding in a controlled position in the overall package structure.

Corresponding defects which detract from package quality will now be explained briefly:

The first defect is a broken filament. Breakage of an individual filament generally has no significant influence upon the strength of the complete thread, so that the thread including the broken filament continues to be wound into a package forming in the wind-up 16. However, after a filament breakage, broken end portions are free to project outwardly from an imaginary thread 'envelope'. They can then catch in parts of the further processing systems referred to above. The 'envelope' in question depends upon the type of thread (smooth or texturised) which in turn depends upon the required end use. Thus acceptable 'envelope' has to be determined by experience and agreement with end users.

Even though the strength of thread is still adequate, catching of broken filaments can lead to a thread break during further processing. Even where a thread break is not induced, defects in the end product can be caused, e.g. a visible flaw in a fabric produced from the thread.

A second defect relates to the structure of the package rather than to the structure of the thread. The thread should be laid into a controlled winding pattern in the package, e.g. with accurately controlled winding angles of each winding relative to the longitudinal package axis. Due to faults in the winding operation, however, windings may be displaced relative to each other, e. g. by slippage of one or more windings on the underlying package windings. There will then normally be a slight excess length of thread in a displaced winding, and this length of thread projects as a small loop from the outer package surface until it is overlaid by subsequent new windings. In this case, therefore, the current outermost package winding represents the relevant 'envelope', which grows continually during build up of the package to its maximum diameter. Winding of the package can be continued to completion, but the displaced windings produce tension variations during unwinding for further processing and these can produce thread breaks.

Accordingly, the number of broken filaments and the number of loops caused by displaced windings are important quality characteristics for a thread package. The monitoring device now to be described with reference to FIG. 2 enables an indication of these characteristics for each thread package produced at the wind-up 16.

In FIG. 2, the friction roll is shown again at 18. The full-line segment 26 represents part of the periphery of an empty bobbin tube carried by chuck 20 (not shown in FIG. 2) in the initial winding position. The bobbin tube is in friction engagement with roll 18. The dotted line segment 28 represents part of the outer circumference of the package 22 when the chuck 20 is in its final winding position, that is when the package 22 is fully wound. The package is still in frictional engagement with roll 18. The dotted line segment 28a represents part of the outer circumference of the package 22 when the chuck has been moved to its rest position at which the package will be removed and replaced by a fresh bobbin tube. Assume that the axis of roll 18 is fixed relative to a machine frame (not shown). Also secured in the machine frame beneath roll 18 is a bar 30 which is rotatable about a longitudinal axis 32 extending parallel to the roll axis. Fixedly secured to bar 30 is an arm 34 projecting radially relative to rotation axis 32, At its free end, arm 34 supports a holder 36 which in turn carries a detector head 38 of a monitoring device according to the invention.

The main element of detector head 38 is a charge collector 40. This is in a form of an elongate rod of electrically conductive material extending over the full length of the package 22. The rod is mounted in a body 42 of non-conductive material, which in turn is mounted in holder 36. Body 42 also extends over the full length of package 22. Body 42 has a slightly curved surface S facing away from holder 36 towards bobbin 26 and a package 22 (FIG. 1) forming thereon.

Rod 40 is so mounted in body 42 that a free edge 'E' of the rod 40 is slightly closer than the surface 'S' to the bobbin 26 and package 22. For example, rod 40 may be provided by an elongated plate element embedded in a receiving slot in the body 42 with a small edge portion, including the edge 'E', projecting from the receiving slot.

Bar 30 can be rotated about its axis 32 to move arm 34 to an initial position illustrated in full lines in FIG. 2. In this position, edge 'E' is held at a predetermined spacing 'd' from the periphery of bobbin 26 when the chuck is in its initial winding position. The space formed between the periphery of the bobbin 26 and the surface 'S' converges in the direction of rotation of the bobbin as indicated by the arrow thereon in FIG. 2. As package 22 builds-up on bobbin 26, bar 30 is rotated by a controllable moving means (to be described) so as to maintain a substantially constant spacing 'd' between the edge 'E' and the expanding periphery of the package 22. The final position of the arm 34 and the parts carried thereby, at the end of a winding operation, is indicated in dotted outline in FIG. 2.

An electrical lead 44 extends from the machine frame along bar 30 and arm 34 to the holder 36. It than passes through a suitable opening (dotted lines) in body 42 to make electrical contact with rod 40. Within the machine frame, lead 44 is connected to an evaluation circuit, one possible embodiment of which will be described later with reference to FIG. 3. The evaluation circuit is responsive to the electrical potential of the point of connection of lead 44 with rod 40. Assume firstly the idealised situation of a perfect winding operation in which rod 40 remains at a constant electrical potential ('0') throughout the winding operation. The evaluation circuit will then indicate zero package defects for that particular operation.

Assume now that a single filament breaks in the thread upstream from the wind-up 16 just before the start of the next winding operation. Breakage of a single filament does not prevent continuation of the winding operation and the broken filament is drawn along with the thread into the package which is beginning to form on the bobbin 26. The latter is still in or very close to its full line position as shown in FIG. 2. When the broken filament ends have passed the point P at which the thread is transferred from friction roll 18 to the newly forming package, centrifugal force acting on each broken filament end will tend to urge it radially outwardly from the package. The main length of the broken filament is still bound into the thread structure as a whole (by interlacing of the filaments which inevitably arises in an operation of the type described) but an uncontrolled 'tail' portion may be urged outwards by centrifugal force to project radially outwardly from the package circumference. At a certain angular spacing from the position P this tail will reach its maximum degree of projection beyond the package circumference. The required angle of rotation beyond P is relatively small, substantially less than $\frac{1}{4}$ of a revolution. As shown in FIG. 2 the angular position of the rod 40 relative to the bobbin 26 is a such that a projecting tail T has travelled the greater part of a full revolution after entering the package before it comes into angular alignment with the rod 40. This ensures that the tail T has reached its maximum degree of projection from the package, and it also enables the accumulation of electrical charge on the surface of the tail T due to friction between the projecting tail and the air surrounding the package. The spacing 'd' is so chosen that normally tail T will engage at least the edge 'E' as it passes the rod 40. The spacing 'd' is furthermore so chosen that normally the tail T will engage the surface 'S' before it engages the edge 'E'. Friction between the surface 'S' and tail T further increases the charge accumulated on the tail.

This accumulated charge is transferred to the rod 40 during engagement of the tail with the edge 'E'. The transferred charge changes the potential at the connection of rod 'E' with lead 44, and this change of potential is detected by the evaluating circuit and registered as a package defect. As the package build-up continues, the tail T will be gradually overwound by further thread so that it will no longer make contact with the detector head 38. The potential of rod 40 will return to normal ('0') and the evaluation circuit will cease to register a package defect.

It will be realized that a filament break produces two broken filament ends in the thread whereas only one tail T has been shown in FIG. 2. This is the anticipated normal behaviour because the movement of the air at the package periphery relative to the rotating package will oppose the effect of centrifugal force on the 'upstream' end and tend to maintain that end in alignment with the thread structure. The same relative air movement will assist the effect of centrifugal force on the 'downstream' end which will therefore normally be raised away from the package surface to form the tail T. The actual length of the tail T is uncontrollable being dependent upon random variations in the arrangement of the individual filaments in the thread structure. The selection of the spacing 'd' and the curvature of the surface 'S' must therefore be selected empirically on the basis of statistical assessments of 'normal' tail lengths. These may vary with the type of thread being processed.

By chance, the filament arrangement may occasionally be such that no tail or only a very short tail can be formed. In these circumstances, the presence of the defect will not be detected because there will be no contact between the broken filament end and the rod 40. Experience shows, however, that a spacing 'd' of 2 to 4 mm enables detection of the most significant proportion of broken filament defects which occur in practice. The preferred value for spacing 'd' is 3 mm with a tolerance of +/−0.5 mm.

The detection of 'loops' caused by displacement of a thread windings in the package structure is essentially similar to the detection of broken filaments. Each loop projects from the package periphery in a manner similar to the tail T shown in FIG. 2, and contacts the rod 40 in the same way. The angle of rotation of the package between the first occurrence of a loop and the contact thereof with the rod 40 is not of course controllable. Accordingly, the body 42 is particularly useful in this case to ensure adequate accumulation of charge on a loop to enable detection of a change of electrical potential of the rod 40 due to transfer of charge thereto. However, even if a loop is not adequately charged on its first revolution, it is likely to remain projecting from the package surface during more than one subsequent revolution so that there will be further opportunities for loop detection.

It is clearly important that the spacing 'd' is held as near as possible constant throughout a winding operation. As the package 22 builds-up, therefore, detector head 38 must be withdrawn from its initial position toward its final position by rotation of arm 34 and bar 30 about axis 32. The controllable moving means for effecting this withdrawal is provided in the illustrated embodiment by an electrical stepping motor 46, fixedly mounted on the machine frame, and a length of flexible line 48 connected at one end to a capstan 50 driven by motor 46 and at the other end (52) to the arm 34. A segment 54 is secured to the arm 34 and engages the flexible line 48 throughout the winding operation, the angular extent of contact of the line 48 with the circular surface on segment 54 varying during the winding operation to ensure that each step of stepping motor 46 has the same effect in terms of withdrawal of head 38 from its initial position, that is in terms of rotation of arm 34 about axis 32. A spring bias, not shown, is provided to urge arm 34 toward its initial position, so that line 48 is maintained taut and withdrawal is effected against the spring bias.

A control device (not shown) of conventional construction may be provided selectively to energize stepping motor 46. The qontrol device is responsive to a proximity sensor mounted in detector head 38. The illustrated proximity sensor comprises a fibre optic element 56 adapted to collect light reflected from the outer surface of the package 22 and a signal generator 58 adapted to produce an electrical output signal representative of light collected by element 56. A lead 60 extends along arm 34 and bar 30 from generator 58 to the control device referred to. When the output from generator 58 indicates that spacing 'd' has reached a predetermined minimum value (in the preferred embodiment 2.5 mm) the control device energizes motor 46 to cause it to step once. Head 38 is thereby withdrawn from package 22 to an extent sufficient to create a predetermined maximum spacing 'd' (in the preferred embodiment 3.5 mm).

FIG. 3 shows a block diagram of an evaluation circuit for evaluating the condition of the detector rod 40. The evaluation circuit comprises an input device indicated by block 62 and a filter indicated by block 64. Both the input device and the filter are of substantially conventional electrical design, and accordingly their individual elements will not be described here. Instead, the function of each device will be described in outline below.

Input device 62 is designed as an impedance matching device. Device 62 has no effect upon the form of the output signal from rod 40 but adapts the apparent impedance of the rod (as seen at the input to the filter 64) to a value suitable for optimal operation of the filter itself. Before considering the filter, it is appropriate to examine the form of the output signal from the rod, a diagramatic representation of which is shown in FIG. 3A.

In the description of operation of the mechanical arrangement as seen in FIG. 2, the ideal condition of a substantially constant electrical 'background' potential ('zero') of the rod 40 was assumed for convenience. Such a condition will not be achieved in practice. A spin draw winder includes a large number of electrically operated elements, many of which will be producing stray electrical fields in the region of the rod 40. The latter will therefore tend to act as an antenna producing a continually varying output signal dependent upon the stray fields instantaneously present in its neighbourhood.

This produces a continuous background 'noise' signal. In FIG. 3A, taking time t on the horizontal axis and potential or voltage on the vertical axis, the noise signal is represented as a signal of maximum amplitude 'n' varying relatively slowly around a mean '0' level shown as the horizontal axis. The major components of this noise signal will be of relatively low frequency, e.g. related to the frequency of the mains supply to the spin-draw-winder.

When charge is transferred to rod 40 the mean potential of the input signal to the filter 64 is shifted rapidly through a magnitude 'm' from its instantaneous 'background' level. The potential then rapidly returns to the background level as the collected charge carriers are discharged from the rod 40. The collection and discharge of charge carriers therefore produces a pulse input to the filter 64. The electrical components of the leading edge L (FIG. 3A) of this pulse are of substantially higher frequency then the major noise signal components produced by stray fields in the neighbourhood of the rod 40. Accordingly, filter 64 is designed as a high-pass filter which blocks further transmission of the low frequency noise components but transmits the high frequency components contained in the leading edge of the pulse produced by a tail T.

It may be found in some circumstances that relatively high frequency stray fields are also produced in the neighbourhood of the rod 40. In these circumstances, filter 64 can be designed as a band pass filter removing both the low frequency (mains frequency) components and the relatively high frequency components from its output signal. The precise design of filter 64, in particular its exact cut-off frequency (high pass) or cut-off frequencies (band pass), can be determined empirically in dependance upon the required operating circumstances.

The detailed design of filter 64 can be adapted accordingly.

It is clearly important to minimize the noise signal level in this system. Rod 40 should therefore be isolated as far as possible from stray fields. Lead 44 is preferably also isolated from stray fields, e. g. a coaxial cable, and the leads joining the respective elements of the evaluation circuit in FIG. 3 are also preferably isolated as indicated in the FIG. Devices 62 and 64 are preferably contained within respective metal shielding housings.

FIG. 3A shows one pulse signal associated with a single tail T on one revolution of the package. In practice, the same tail T will almost certainly produce a series of pulses at the input to filter 64, one pulse per revolution of the package, until the tail is sufficiently overwound to prevent further contact between it and the rod 40. Theoretically two or more tails might project simultaneously from the surface of the package due to respective filament breakages within a very short space of time. The pulse train appearing at the input to the filter 64 will therefore contain more then one pulse per package revolution. A phase sensitive device could therefore be provided to relate the pulse trains to the package rotation so as to distinguish 'multiple contact' revolutions from 'single contact' revolutions. A large number of tails T projecting simultaneously from the package surface is, however, unlikely. In such circumstances the thread would probably break.

On the other hand, stroboscopic examination of the surface of a thread package during winding displacement faults shows that a comparatively large number of loops are produced at the surface within in a very short space of time, i. e. within one package revolution. Accordingly, filter 64 can be followed by a suitable counter (not shown), which is also responsive to the package rotation, so as to count the number of 'pulses' per revolution. By this means, winding displacement faults may be distinguishable from filament breakage faults. Seperate registration means could then be provided for each fault type.

In general, however, it is sufficient for the end user to know that the total number of filament breaks and winding defects in the package. In this case the evaluation circuit can be set to register each 'pulse train' (a single pulse may in this context represent a 'train') as one defect.

The invention is not limited to details of the embodiment illustrated in the drawings. For example the 'charging' body 42 may be unnecessary depending upon the operating circumstances. Synthetic plastics filament normally regularly collects and stores static electrical charge. However, the performance of an individual thread in this respect will be dependent both upon the specific plastics material and upon any spin finish or lubricant applied in the course of the spinning operation. The charge storing capacity of individual filaments may be so reduced in some circumstances that even additional charging of the thread with a friction surface proves inadequate to produce the necessary signal to noise ratio for the evaluation circuit. In such circumstances, an energized charging device may be arranged to produce an electric field in the neighbourhood of the package surface in the region upstream from the rod 40 considered in the direction of rotation of the package.

In principle the detector head 38 could be located at any position around the package periphery after the tail T has reached an adequate degree of projection from the package surface after leaving the nip line at P. However, if a system of Cartesian co-ordinates is defined centered on the longitudinal chuck axis and with 'horizontal' or 'X' coordinate axis passing through the nip line between the package and friction roll 18, then it will normally be preferable to locate the detector head in the third or fourth, and most desirably in the fourth, quadrant of that coordinate system. This ensures that the tail T has reached its maximum extension from the package periphery before it reaches the rod 40. Furthermore a tail T which was 'discharged' by contact with the metal surface of the friction roll 18 at the nip line P has time to 'recharge' before it reaches the rod 40 by reason of air frictional drag. Still further in the great majority of winding machines it is much easier to make space available in the third and fourth quadrants of the above defined coordinate system than in the first and second quadrants. The space at the periphery of the package in the latter two quadrants is normally already taken up with various other machine parts.

It is very advantageous to associate the detector head 38 with the periphery of the package as the latter is built-up. The centrifugal force acting on the tails or loops associated with the package urges them outwardly to make contact with the collecting element (rod 40) of the detector head. Furthermore, the 'quality control' is made in a final stage of the spin-draw-wind operation, thus providing the maximum relevant information. In particular, the detector head can react to both filament breakages as represented by tails and to displaced windings as represented by loops.

However, the invention is not limited to this most preferred arrangement. Simplification can be achieved at the cost of loss of overall information. For example the detector head 38 could be associated with the periphery of the friction roll 18 in a region thereof contacted by the thread as it passes to the package.

Since the roll axis is fixed, and since the thread does not build-up around the roll, the head 38 can be mounted in a fixed position relative to the friction roll. The complications of the stepping motor and systems for measuring a desired spacing to enable control of the stepping motor can be simply eliminated. The advantage of the action of centrifugal force is maintained, but the system can clearly no longer respond to displaced windings which have not been formed at the time of the quality inspection. Furthermore, some problems may arise due to leakage of accumulated charge from the thread to the metal surface of the friction roll. Such problems may, however, be overcome by more intensive application of static charge to the thread, e.g. with a positively energized charging device as briefly referred to above.

In principle, the same remarks apply to association of the detector head with any other curved portion of the thread path, e.g. on a draw roll. However, the further upstream the quality inspection is taken, the less valuable information can be expected to be extracted from the system due to the possibility of additional, unmonitored 'downstream' events.

As mentioned above, the wind-up may be of the waste-free changeover type, having a plurality of chucks brought successively into winding association with the friction roll 18. In revolver-type systems (e.g. as shown in U.S. Pat. No. 4,298,171) the 'geometry' (that is, the pattern of relative movement of the machine parts) of the winding operation is the same for both chucks. Where the monitoring apparatus is to be associated with the package rather then with a relatively fixed part of the machine, it will be necessary to ensure that the monitor does not interfere with the changeover operation.

The monitor could, e.g., be temporarily retractable during the changeover from an operative to an inoperative position. However, the path of movement and mode of control of the monitor during the actual winding operation can be the same for both chucks.

On the other hand, in a waste-free winder of the type shown in U.S. Pat. No. 4,524,918, the geometry of the winding operation is radically different for the two chucks. However, a single monitor may still serve for both chucks. For example, if chuck 20 forms the lower chuck of the chuck pair shown in the illustrations of U.S. Pat. No. 4,524,918 than the upperchuck shown in those illustration can nevertheless bring a bobbin tube into an initial winding position within the operating range of the detector head 38 shown in FIG. 2 of the present application. Furthermore, the arrangement can be such that the 'underside' of the package building on the upper chuck remains accessible to the head 38 throughout the winding operation. In the machine layout shown in FIG. 15 of U.S. Pat. No. 4,524,918 (which a full package can remain 'stored' upon one chuck throughout a normal winding operation on the other chuck), it will be necessary to ensure that the arm 34 with its head 38 can swing past a package stored on the lower chuck in order to come into association with a newly forming package on the upperchuck. This, however, gives rise to no particular difficulty as can be seen from consideration of FIG. 2 of the present application.

As already indicated above, the chuck 20 (or each chuck of a multi-chuck machine) may carry more than one bobbin tube for winding of a plurality of thread packages simultaneously.

It is than desirable to have a separate detector head for each package. Furthermore, each detector head should have its own mounting and moving system, independent of the other heads. Evaluation circuitry may be independent for each head, or in common, as desired. The alternative arrangement, in which a single detector head extends over substantially the full length of the chuck and co-operates simultaneously with each package thereon, would obviously provide significantly less quality information regarding the individual packages.

The system can employ alternative detector types, for example photoelectric 'barriers' using light beams directed axially of a package and be interrupted by the passage of a thread portion though a location spaced from the package periphery. It will, however, be relatively difficult to associate such light barriers with respective thread packages being wound side-by-side on a common winding axis in a single wind-up although it may be possible to displace adjacent light barriers angularly about the common axis.

In some circumstances, it is necessary to break off a winding operation and to move a chuck as rapidly as possible, e.g. when a fault has been detected somewhere in the system. It may then be desirable to retract the detector head or heads 38 as rapidly as possible to avoid interference with the return movement of the chuck to its rest position. A selectively operable, auxiliary moving mechanism may be provided for this purpose. For example, a linearly movable member (not shown) could be provided to form a loop in line 48 between the capstan 50 and the segment 54 so as to withdraw the arm 34 rapidly from a position in association with a thread package. The linearly movable member could, e.g., comprise a pressurable piston and cylinder unit provided with a suitable engaging means (e.g. a roller) for engaging the line 48. It will be clear, however, that alternative arrangements could be provided to produce the same effect, and an auxiliary moving means may be unnecessary if the primary moving means can be rapidly accelerated.

The specific illustrated primary moving means (that is, the stepping motor 46 and line 48) and also the specific illustrated control system therefore (that is, the sensor 56, generator 58 and non-illustrated contol device linking generator 58 with motor 46) can be varied depending upon the operating circumstances and requirements. An alternative control system could, e.g., respond to sensing of relative movement of the chuck and friction roll during build-up of package. Such relative movement is commonly achieved in practice not only by movement of the chuck relative to the machine frame (as shown in FIGS. 1 and 2) but also by movement of the friction roll relative to the machine frame, the chuck axis then being fixed relative to the frame. Alternatively, a moving means for controllably moving the detector 38 during the winding operation could be omitted altogether; the arm 34 could be simply spring biased in a direction towards the package, and a contact shoe could be mounted on the arm 34 in a manner permitting it to ride on the surface of the package and thereby determine the spacing of the rod 40 from that surface. Where a proximity sensor is used it is not necessarily of the fiber optic type e.g., a pneumatic sensor could also be used.

Furthermore the mounting system for the head 38 shown in FIG. 2 could be changed. Where the chuck 20 is carried by a swing arm for movement along the path 24, the detector head 38 could be mounted on the swing arm for movement longitudinally of the arm in dependence upon package build-up. A suitable linkage could be provided between the movement of the swing arm and the mounting for the detector head, so that the position of the head along the swing arm is dependent upon the position of the swing arm on its predetermined path of movement for a normal winding operation.

We claim:

1. A method of monitoring the degree of compactness of a thread or a body of thread during winding comprising the step of sensing projection of a thread at a predetermined location beyond a predetermined curved thread path on the periphery of a thread package continuously as the package is being formed from the thread as a measure of the compactness of the thread or thread body.

2. In combination a thread package forming means; and a device for monitoring the degree of compactness of a thread or body of thread during forming of a package on said means, said device comprising sensing means responsive to presence of a thread at a predetermined location and mounting means for mounting and maintaining said sensing means with a predetermined spacing from a surface of the package forming on said thread package forming means.

3. A device as claimed in claim 2 wherein said sensing means comprises an electrically conductive element adapted to receive electrical charge from a thread projecting beyond said curved thread path.

4. A device as claimed in claim 3 wherein said sensing means is adapted to produce an electrical output signal and signal processing means is provided to eliminate from said output signal components representing stray electro magnetic fields in the neighborhood of said sensing means.

5. A method of monitoring a travelling thread comprising the steps of passing a travelling thread through a curved path to impart a centrifugal force on the thread within said path; and monitoring a predetermined location spaced from said path to receive an electrical charge from at least a broken part of a travelling thread at said location; and emitting a signal in response to the reception of an electrical charge from at least a broken part of a travelling thread at said location.

6. A method as set forth in claim 5 wherein the thread is selected from the group consisting of a multifilament thread and a thread having a fibrous structure.

7. A method as set forth in claim 5 wherein said signal is emitted in response to a physical contact of a broken thread part with a detector element at said location.

8. A method of monitoring a travelling thread comprising the steps of winding a travelling thread onto a curved surface to form a thread package;

monitoring a predetermined location spaced from the curved surface for detecting the presence of at least a part of the thread at said location;

moving the location continuously from the curved surface during winding of the thread thereon to maintain a constant spacing of said location from the thread package; and emitting a signal in response to the detection of the presence of at least a part of the thread at said location.

9. A method as set forth in claim 8 which further comprises the step of processing said signal to eliminate components introduced by stray electromagnetic fields at said location.

10. A device for monitoring a travelling thread comprising rotatable means for defining a curved thread path; and sensing means for monitoring a predetermined location spaced from said path to detect the presence of at least a broken part of a thread travelling through said path, said sensing means including an electrically conductive element for receiving an electrical charge from a broken thread path projecting from said thread path into said location.

11. A device as set forth in claim 10 wherein said rotatable means is a drum.

12. A device as set forth in claim 10 wherein said rotatable means is a chuck for receiving a bobbin tube for winding of a thread package thereon and which further comprises mounting means for moving said sensing means continuously away from said chuck during winding of a thread to maintain a constant spacing of said location from the thread package.

13. A device for monitoring a travelling thread comprising rotatable means for defining a curved thread path; and sensing means for monitoring a predetermined location spaced from said path to detect the presence of at least a broken part of a thread travelling through said path, said sensing means including a detector head having an electrically conductive charge collector rod and an evaluation circuit connected with said rod to sense changes in electrical potential of said rod due to contact with a travelling thread part.

14. A device as set forth in claim 13 wherein said detector head includes a curved surface upstream of said rod for sliding thereon of a thread part projecting from said path to increase an electrical charge in said thread part.

* * * * *

UNITED STATES PATENT AND TRADEMARK OFFICE

CERTIFICATE OF CORRECTION

PATENT NO. : 4,677,387

DATED : June 30, 1987

INVENTOR(S) : HEINZ MUTTER, et al

It is certified that error appears in the above-identified patent and that said Letters Patent is hereby corrected as shown below:

Column 3, line 12 "detector" should be - the detector-
Column 3, line 16 "diagramatic" should be -diagrammatic-
Column 3, line 20 "diagramatic" should be -diagrammatic-
Column 4, line 7 "16 a" should be -16, a-
Column 6, line 63 cancel "a"
Column 7, line 50 "windings" should be -winding-
Column 8, line 53 "gramatic" should be -grammatic-
Column 9, line 65 cancel "in"
Column 11, line 51 "illustration" should be -illustrations-
Column 12, line 16 cancel "be"
Column 13, line 43 "electro magnetic" should be -electromagnetic-
Column 14, line 31 "path" should be -part-

Signed and Sealed this

First Day of December, 1987

*Attest:*

*Attesting Officer*

DONALD J. QUIGG

*Commissioner of Patents and Trademarks*